US005331749A

United States Patent [19]

Thiele

[11] Patent Number: 5,331,749

[45] Date of Patent: Jul. 26, 1994

[54] MULTI-FUNCTIONAL NOZZLE BLOW BOX

[76] Inventor: Eric W. Thiele, W9816 Cedar Rd., Fremont, Wis. 54940

[21] Appl. No.: 973,622

[22] Filed: Nov. 9, 1992

[51] Int. Cl.[5] ..... F26B 13/20

[52] U.S. Cl. ..... 34/117; 34/120

[58] Field of Search ..... 34/115, 114, 116, 117, 34/23

[56] References Cited

U.S. PATENT DOCUMENTS 992,688 6/1911 Pope ..... 34/117

4,274,210 6/1981 Stengard .

OTHER PUBLICATIONS

"A New Concept for Air or Vapor Impingement Drying", by R. H. Page et al, 1990 Engineering Conference, pp. 387–392.

*Primary Examiner*—Henry A. Bennet

*Attorney, Agent, or Firm*—Sughrue, Mion, Zinn, Macpeak and Seas

[57] ABSTRACT

An improved air drying process for a paper machine is disclosed whereby air is impinged directly onto a paper web between top and bottom dryers on an open paper draw. This provides additional drying and machine speed increase due to improved controlling of sheet flutter and improved drying via direct air impingement onto the sheet for all paper grades. The structure provides a radial jet reattachment nozzle to blow air onto the sheet while the paper web is not in contact with either cylinder surface and the fabric or felt. The nozzle stabilizes and supports the sheet to prevent sheet flutter and bulging.

19 Claims, 8 Drawing Sheets

MULTI-FUNCTIONAL NOZZLE BLOW BOX

FIELD OF THE INVENTION

The present invention relates to paper machine drying concepts and methods of air drying in the paper machine drying sections. More particularly, the present invention relates to the open draw sections of paper machine dryers where the paper web travels from top cylinders to bottom cylinders and then again from bottom cylinders to the upper cylinders, in an unsupported fashion. The invention could also be applied to a dryer section where the moist web is supported by a fabric or felt in a single tier or uni-run system.

BACKGROUND OF THE INVENTION

In a papermaking process, a moist paper web, after passing through mechanical water removal stations and a series of press nips, continues to pass over a series of heated cylinders that evaporates water form the web to approximately 95% dryness. The paper web, in a typical dryer section, is unsupported as it travels in a serpentine fashion between upper and lower dryer cylinder arrangements. A top and bottom fabric loop is arranged to guide the web around the cylinders. A top fabric or felt, guides the web around the group of top cylinders, which are situated in a single row at a high elevation, with felt turning rolls located between them and a lower fabric or felt run is similarly situated at the lower level. The web travels alternately between top and bottom cylinders. The top fabric or felt run disengages at the above location from the cylinders and the paper web, continuing to a fabric or felt turning roll, passing through a series of cylinders and felt rolls until the fabric is guided above the dryer section via turning rolls of a guide and stretcher arrangement in a closed loop fashion. A similar arrangement is fashioned for the bottom dryer section, creating an opposite fabric loop system for the lower dryer group.

The stretch or distance that the moist paper web has to travel from the upper dryer group to the bottom dryer group, unsupported by either cylinder or fabric, is called the open draw.

The conventional process through the industry is to include the supply air via different pocket ventilation systems using blow boxes of many and varied systems behind the fabric or felt turning rolls (i.e. above top felt turning rolls and below bottom felt turning rolls). The air from these blow boxes has to travel through the fabric in order to infiltrate the pocket of the open draw. This requires high open permeability of the fabric and, at high machine speed, much of the air is deflected, requiring a high air volume and high horsepower to force air through the fabric. Another standard method is to introduce air via the felt turning rolls, forcing air through the fabric into the pocket.

In either of the conventional cases, the air from the supply thereof is infiltrated into the pocket through the fabric itself and the ventilating felt roll systems as described above.

It is an accepted fact that if too much air is introduced into the pocket, the web bulges causing sheet breaks, especially where the sheet has a high moisture content and is consequently very weak. In addition, edge flutter may occur, especially at high machine speeds where the edge might stretch, causing a wrinkling effect in the web. Also, introducing an air jet directly perpendicular to the unsupported paper web can blow the sheet away from the jet, causing web breakage.

SUMMARY OF THE INVENTION

It is the primary object of the invention to address the problems of conventional practices as set out above by supplying air directly onto the paper web in the open draw section without having to move air through a fabric or any other paper or fabric support method in order to improve a mass movement of air onto the web. In accordance with the present invention, air is introduced via a cross-machine pocket ventilation system directly in the dryer pocket.

It is a further object of the invention to provide a method whereby the evaporation from the web is greatly enhanced by creating a high air turbulence on contact with the paper sheet surface. The high air turbulence created and directed onto the sheet results in a very effective scrubbing action at the vapor boundary layer of the sheet, increasing the mass transfer and consequently resulting in a high moisture evaporation rate. Furthermore, by impinging the relatively dry air directly onto the paper web (and avoiding dilution from surrounding relatively humid air which occurs in the conventional practises) the difference in partial pressure due to water vapour between the web and adjacent air is enhanced, thus increasing evaporative cooling in the draw, lowering the sheet temperature and allowing a greater heat transfer from the next steam heated dryer cylinder to the sheet, all resulting in a greater drying force.

It is a major object to accomplish the foregoing additional drying by utilizing a structure which is referred to as a radial jet reattachment nozzle. A standard air jet arrangement blowing perpendicularly to the sheet would blow the sheet away from the jet, causing paper web breakage. However, a unique feature of a radial jet reattachment nozzle is that it creates a negative force onto the web, thus pulling the sheet towards the nozzle, not away from the air impingement system as is common in conventional applications. The paper sheet will actually be pulled into a relatively straight linear web by the negative force of the radial jet reattachment blow box system towards the blow nozzles.

Furthermore, it is an object of the present invention to provide a method to control sheet flutter and sheet bulging without applying additional tension while travelling from an upper dryer cylinder to a lower dryer cylinder, (or vice-versa) the so-called open draw section.

It is still a further object to achieve cross-machine paper web moisture profile control by sectionalizing the multi-functional radial jet reattachment blow box across the width of a paper web.

In order to achieve the above objects, the invention makes use of a new concept for the industrial application of fluid mechanics in the drying of moist materials and centers around the design of a nozzle and reattachment configuration. This design permits the establishment of a radial jet reattachment on an adjacent surface. The radial jet reattachment nozzle produces a highly turbulent flow field which provides high surface transport co-efficients while permitting the magnitude and direction of the overall force of impingement to be controlled.

For the purpose of drying and sheet stabilizing, the invention provides a row of radial jet reattachment nozzles incorporated into a common supply header, introducing air directly onto the sheet in this unsupported paper draw section, whereby the magnitude and direction of the overall force of the impingement air can be controlled. This allows the placement of pocket ventilation air directly into a dryer pocket, adjacent and perpendicular to the paper web, to greatly increase the drying effect of the paper machine drying section, maintain or improve sheet stability, reduce the air humidity with a minimum of air volume and horsepower, and by controlling sections across the multi-functional radial jet reattachment nozzle blow box, control the cross-machine moisture profile of the web as well.

The principal characteristic feature of the invention is that the device comprises a blow box or boxes, complete with one or several arrays of the above described nozzles for the full width of the nozzle box, and then arranged to function against the paper web essentially throughout the width thereof; and whereby the impingement effect of the radial jet reattachment nozzle of the nozzle box is arranged to reach the web while the web is unsupported by either cylinder, fabric or felt.

The operation of the device is based on careful selection of the angle at which air exits the radial jet reattachment nozzles, plus the control of the air flow to the nozzles. These variables determine the pattern of the flow of the air which is responsible for the force which acts on the web. Thus, this controls the overall force of the impingement air onto the web in magnitude and direction by creating areas of underpressure below and between the nozzles via turbulent eddy currents. This control of air force towards the paper web allows the actual pulling of the web towards the radial jet reattachment nozzle box, preventing the normal bulging and sheet flutter that might otherwise occur. Straightening the paper sheet prevents undue web stress, minimizes sheet breaks, machine downtime and sheet wrinkling. While not essential to every application of the invention, the blow box may, if desired, incorporate an additional slot on the edge of the nozzle box to employ the Coanda Effect allowing the air flow to follow the contour of the blow box, evacuating the air before the air enters the area of the dryer and converging paper web after the web has travelled past the multi-functional radial jet reattachment nozzle blow box. By removing the air gently via the Coanda effect, a pressurizing of this area is greatly minimized.

In a device in accordance with the invention, the radial jet reattachment blow box extends over the whole width of the web, but the device may be compartmentalized, or the nozzles may be controlled directly to achieve different evaporation loads across the width of the web to control moisture profiling, thereby improving sheet quality.

DESCRIPTION OF THE DRAWINGS

The invention is illustrated, by way of example, in the accompanying drawings in which.

DETAILED DESCRIPTION OF THE INVENTION

Figure 1:
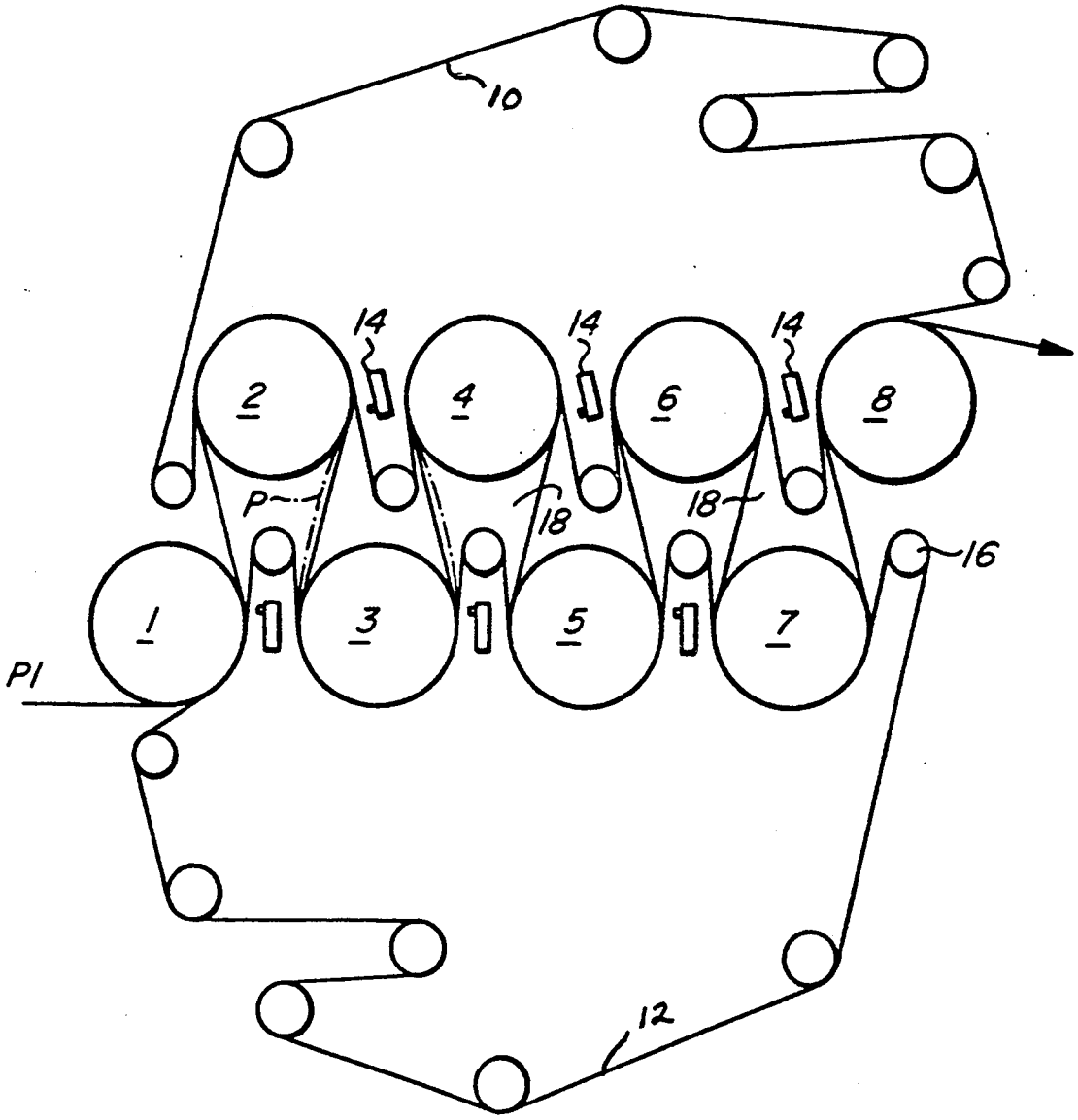
FIG. 1 PRIOR ART
FIG. 1 is a schematic side elevation view of a typical dryer section using the prior art standard pocket ventilation system.

FIG. 1 illustrates a portion of a typical paper machine dryer section including an upper row of drying cylinders 2, 4, 6 and 8 and a bottom row of drying cylinders 1, 3, 5 and 7. As shown a paper web P1 travels from a bottom dryer i to a top dryer 2 and then again from the top dryer 2 to the next bottom dryer 3 and so on in a serpentine fashion. The top and bottom fabric 10, 12 respectively only guides with a certain pressure on the paper cylinder surface. FIG. 1 further illustrates a standard pocket ventilation nozzle 14 supplying air from behind (above or below depending on top or bottom roll) felt turning rolls 16. In this arrangement the air is forced via an air jet arrangement through the fabric to provide air into the dryer pocket 18. On high speed machines, a great amount of air is deflected via the fabric 10, 12 and therefore not effectively introduced into the dryer pocket. Furthermore air which does enter the dryer pocket 18 might cause paper sheet bulging (P) or may create cross-machine air flow causing sheet flutter and wrinkle and sheet breaks can be the result of the foregoing.

Figure 2:
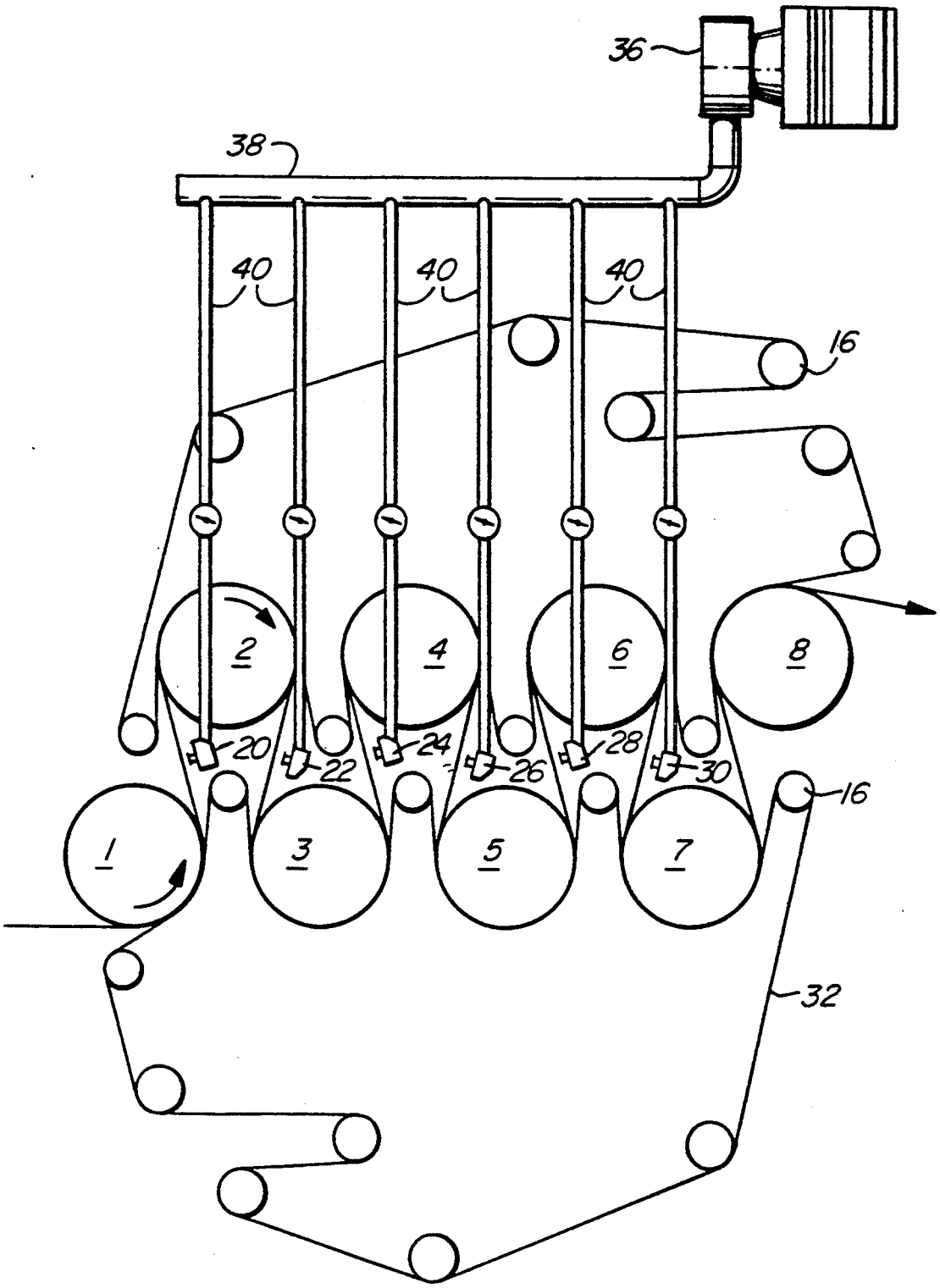
FIG. 2 is a schematic side elevation view of a typical dryer section using a multi-functional blow box system in accordance with this invention.

FIG. 2 illustrates the location of a multi-functional radial jet reattachment blow box 20 according to the invention and located inside the dryer pocket 18 adjacent and perpendicular to the paper web P1. In general, the present invention overcomes the air bulging and sheet flutter problem discussed with respect to the prior art in Figure i by providing a negative force onto the web P1, thus pulling the paper sheet towards the nozzle as a result of the functioning of the radial jet reattachment nozzle 20, subsequently to be described in detail.

The number of blow boxes, nozzles required air flow and the like are specific to each machine. Therefore, for the purpose of example only, FIG. 2 illustrates a total of six nozzle arrangements, 20, 22, 24, 26, 28 and 30, all located either above or below the dryer cylinders outside the fabric loops 32, 34, relocated from the narrow space between the dryer cylinders. The blow box nozzles 20-30 are positioned in a staggered arrangement for uniform drying, as shown by the phantom nozzles 90 in FIG. 5. In general, a paper machine would have many similar dryer sections, as illustrated in FIGS. 1 and 2. Each section would receive in a similar fashion multi-functional nozzles in each dryer pocket 18. While not forming part of this invention, FIG. 2 further illustrates a typical hot air supply unit 36 complete with the necessary ductwork 38, 40 supplying air to all six nozzles 20–30 inclusive.

Figure 3:
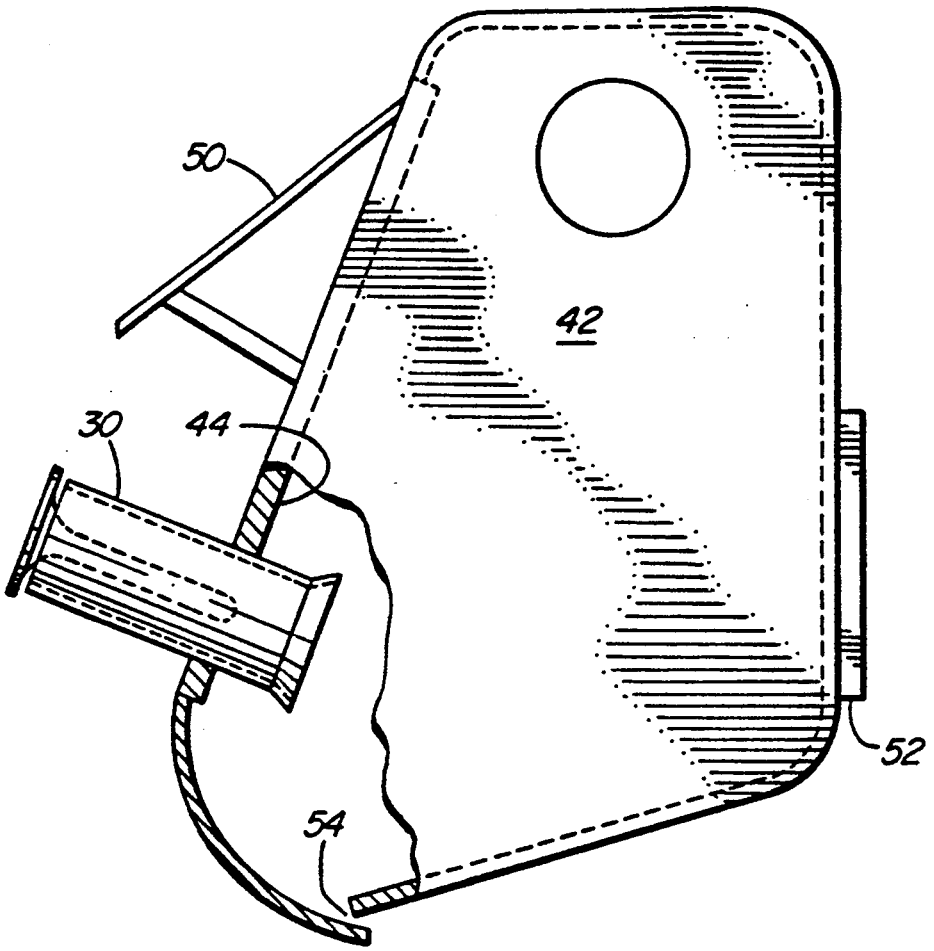
FIG. 3 is an end elevation of a multi-functional blow box and the radial jet reattachment nozzle as used according to this invention.

FIG. 3 illustrates some of the details of the multi-functional radial jet reattachment nozzle box 42 in accordance with this invention. As illustrated therein, the blow box 42 is a hollow shell particularly shaped to be parallel to the web P1, allowing an array of radial jet reattachment nozzles 30 to be mounted at the face plate 44 and having a plenum body feeding each nozzle such as 30 with an amount of air. The nozzle face plate 44 has further a perforated nozzle protection shield 50 to avoid paper hang-up. A cylinder mounting plate 52 is secured to the plenum 42 which makes it possible to achieve a certain pivot movement via a cylinder stroke.

In addition, slot 54 has been added to the plenum to allow air gently to be moved away form the web via the Coanda effect.

Figure 4:
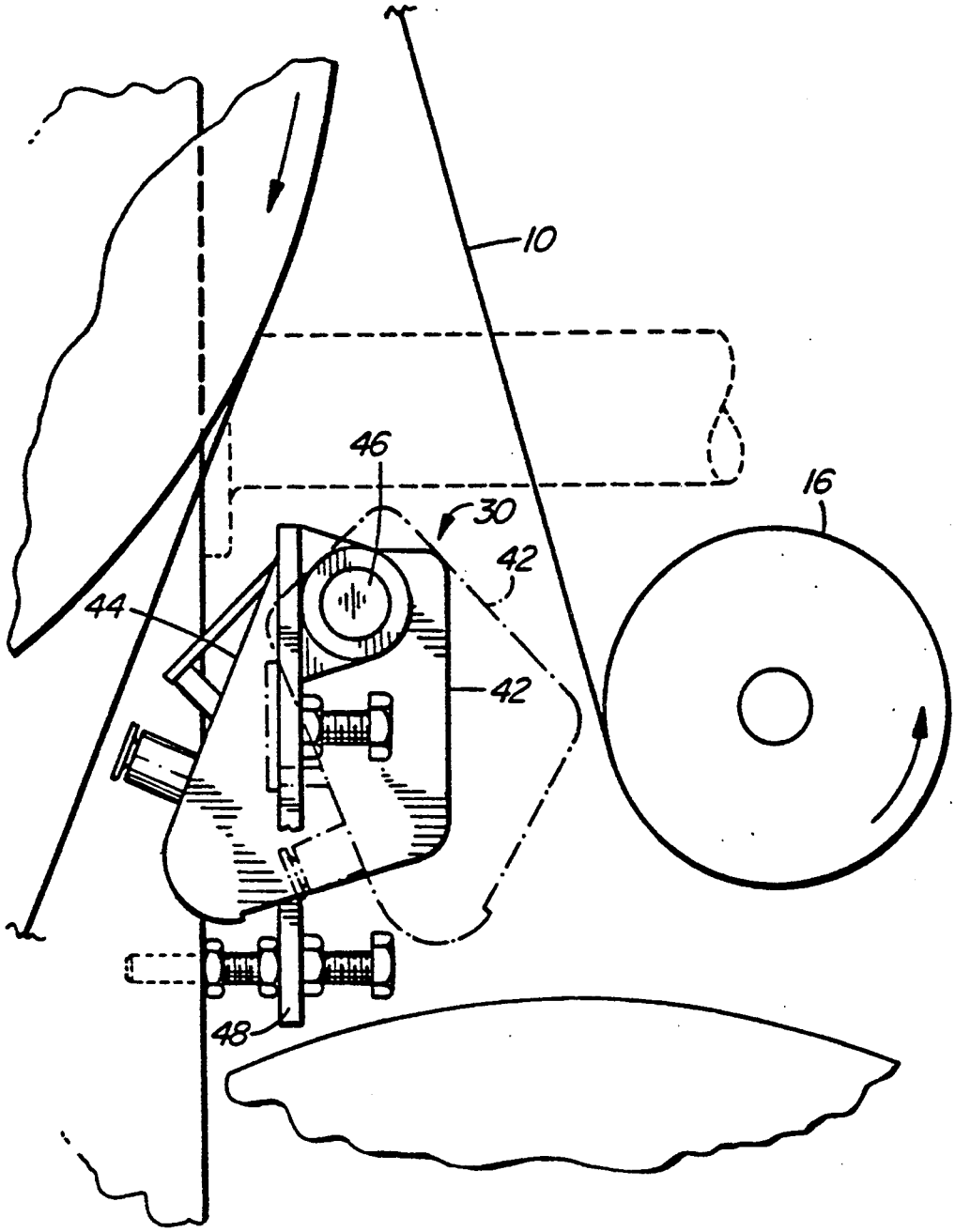
FIG. 4 is a fragmentary side view of a dryer pocket showing the location of the blow box in operating position, and the broken line indicating the blow box retracted position, shown in FIG. 2.

FIG. 4 illustrates nozzle 30 and the associated blow box 42 location above dryer No. 7 and dryer cylinder No. 6 (FIG. 2) at the left side of the box 42. The paper is conveyed from the upper dryer cylinder No. 6 to the lower dryer cylinder No. 7. In the meantime, the fabric 10 has separated from dryer cylinder No. 6 and moves toward the fabric turning roll 16. Thus the paper web P1 is now unsupported between dryer cylinder No. 6 and No. 7, creating the open paper draw.

FIG. 4 further shows the radial jet reattachment nozzle 30 positioned perpendicular to the web and the blow box 42 with a plenum face 44. A pivot point 46 is shown, allowing the radial jet reattachment blow box 42 to pivot away from the paper sheet P1 during threading. Further, a front mounting bracket 48 is shown allowing the blow box 42 to be adjusted fore and aft.

Figure 5:
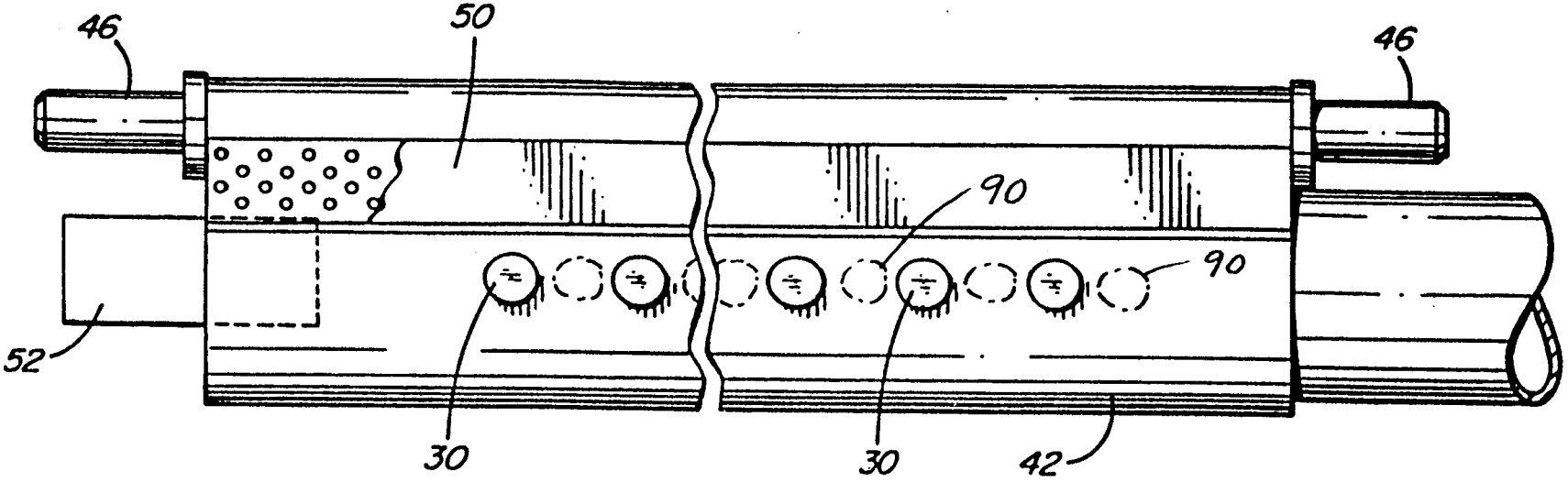
FIG. 5 is a front elevational view of the multi-functional radial jet reattachment blow box.

FIG. 5 illustrates an array of radial jet reattachment nozzles 30 that extend across the paper sheet width to achieve uniform drying across the paper web. The blow box 42 is provided with two pivot supports 46 and the nozzle protection shield 50 over the full width of the nozzle. Air can be supplied from either end of the blow box 42, and similarly, the cylinder to pivot the blow box can be mounted either side.

Various forces act on a paper sheet as the paper travels from one dryer to the next. At the central area of the paper draw between top and bottom dryers, the present invention is utilized to apply a maximum negative force to pull the paper sheet towards the nozzles 30 and to flatten or straighten the paper sheet. The desire to apply the maximum negative force to the paper web at that position dictates the location of the blow boxes and their associated nozzles. The various forces that act on the sheet are for example an adhesion force, a vacuum force, a suction force, a pressure force as well as a centrifugal force from the weight of the paper.

Figures 6A, 6B:
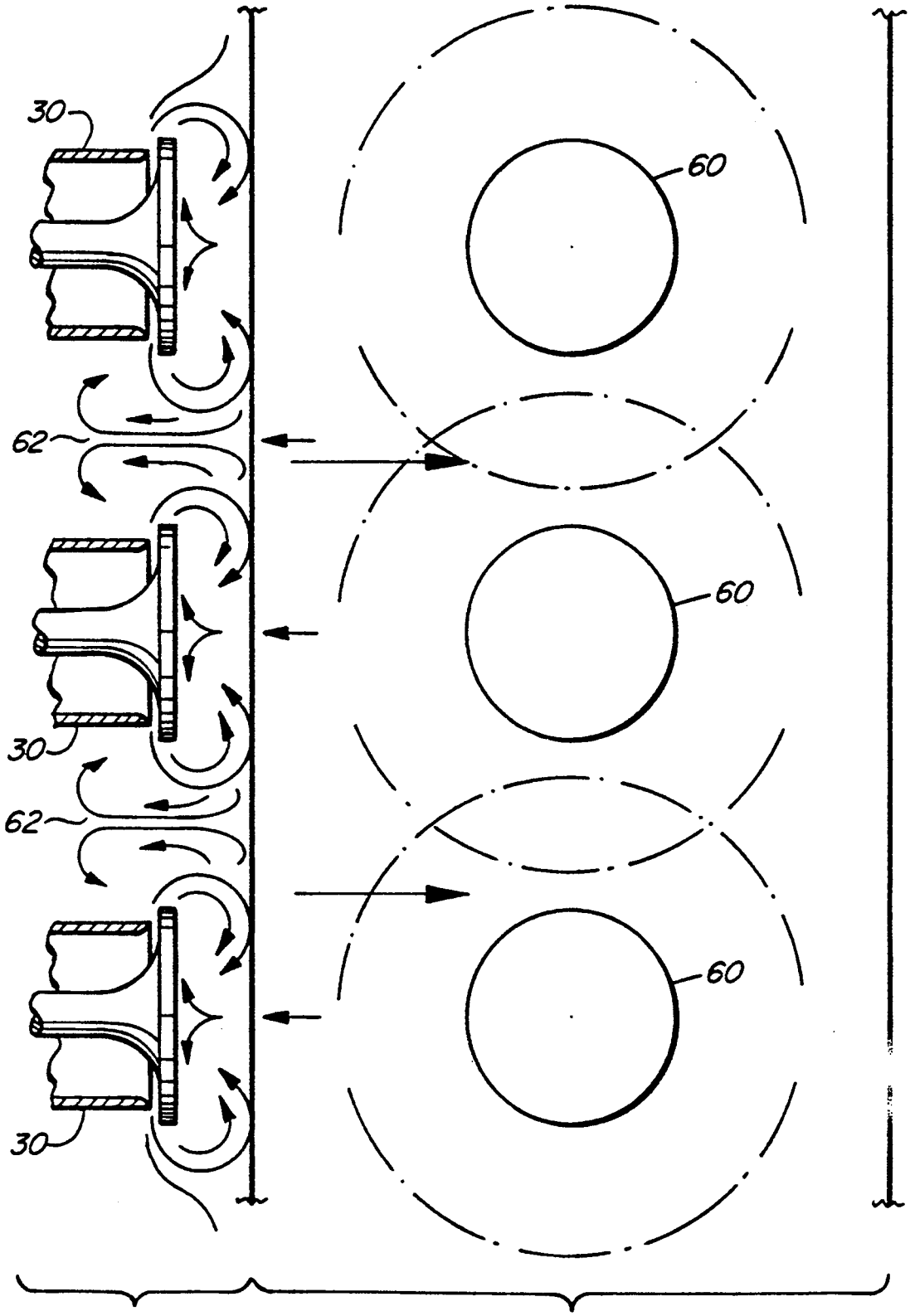
FIGS. 6*a* and 6*b* are schematic cross-section and plan views respectively illustrating the relationship between the forces of nozzle air and the paper sheet.

In the arrangement according to the invention, an air cushion is provided between the head of the nozzles 30 and the paper sheet, this air cushion preventing the sheet from touching the nozzle heads so there is no contact between the metal and the sheet. At the same time, the sheet is forced toward the nozzles via regulation of the air flow from nozzles. FIGS. 6*a* and 6*b* show the path of the air from the nozzle body 30, through the area between the nozzle heads 60 and the bodies of the nozzle, the air flow providing (a) a cushion between the nozzle heads 60 and the sheet itself and also illustrates the air leaving the nozzles in a negative angle which creates a turbulence as at 62 on the sheet with an air flow away from the sheet both immediately underneath the nozzle heads and also between adjacent nozzles 30 and which creates a negative force that pulls the sheet towards the nozzles.

Figure 7:
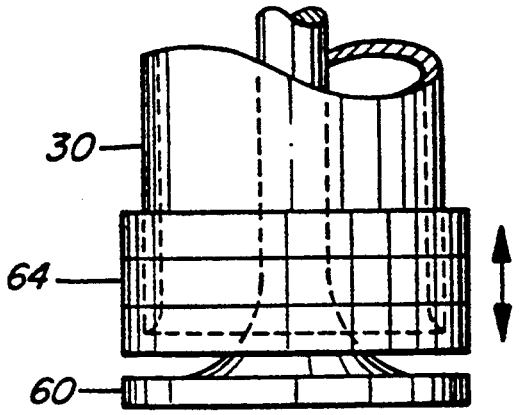
FIG. 7 is a fragmentary view of a nozzle body showing one example for adjusting the nozzle flow.
Figure 8:
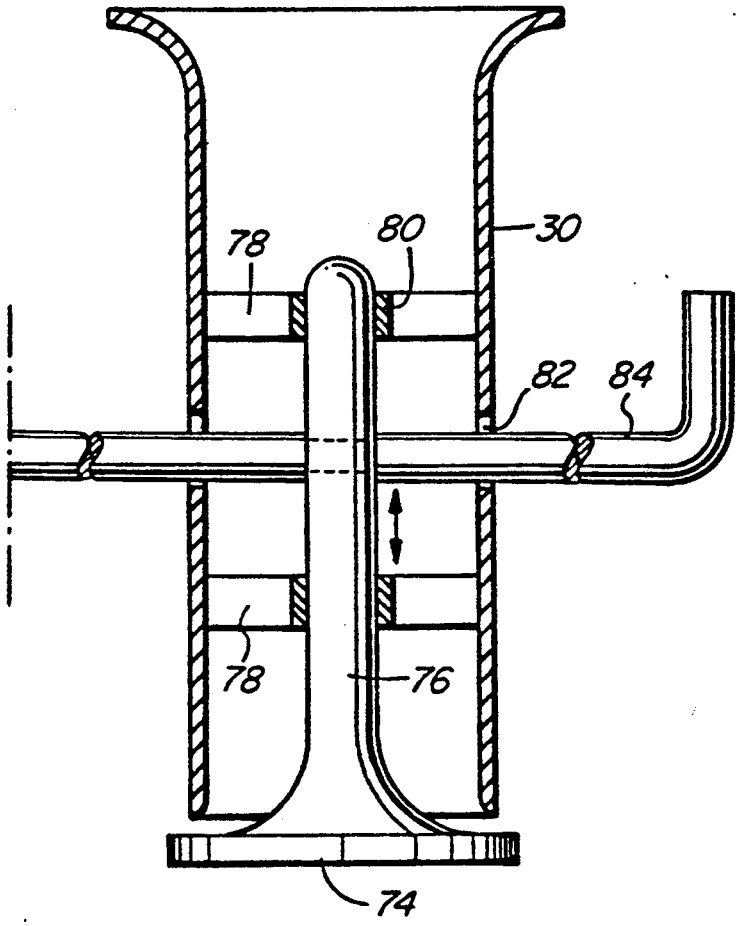
FIG. 8 is a cross-sectional view of the nozzle body showing another example for adjusting nozzle flow.

It may also be desirable to sectionalize the air flow for moisture profiling of the sheet. This could be accomplished by an external adjustment to the nozzles 30, one example being shown in FIG. 7 where a peripheral ring 64 is mounted on the outer surface of the nozzle body for slidable movement therealong whereby the ring can be moved to open or close the peripheral area between the nozzle head 60 and the adjacent rim of the nozzle body so as to regulate the amount of air emanating therefrom. A selective use of the rings 64 on a plurality of nozzles on the blow box, could be utilized to apply a desired amount of drying and air forces to specific areas of the web.

Figure S illustrates a further example of adjusting the amount of air emanating from the nozzle. Nozzle body 30 has a nozzle head 74 and its associated stem 76 slidably mounted for axial movement in the body 30. This is accomplished by a pair of spaced mounting brackets 78 having central collars 80 in which the stem 76 is slidably positioned.

An aperture 82 in the cylindrical wall of the nozzle body accommodates an adjusting rod 84 which may interconnect one or more stems 76 and which can be manually or automatically actuated to move the stem 76 and head 74 inwardly or outwardly to open or close the space between the peripheral edge of the nozzle body and the adjacent surface of the head 74.

The sliding rings 64 and the axially moveable nozzle stems and heads are but two examples of means for adjusting the air flow and these could be actuated either manually or automatically, for example, responsive to web moisture.

Figure 9:
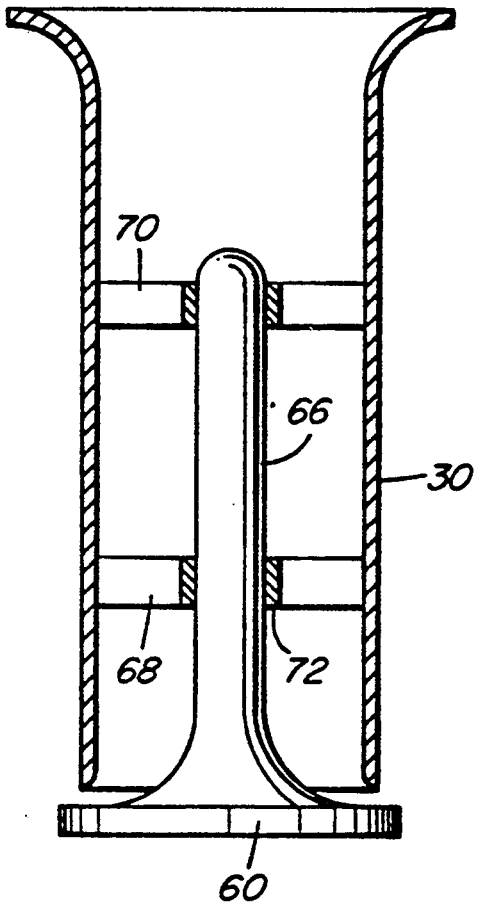
FIG. 9 is a cross-sectional view of one form of nozzle structure.

FIG. 9 shows one example of a nozzle structure in which the tubular or cylindrical nozzle body 30 has the nozzle head 60 located in the body 30 by means of an elongated stem 66 securely positioned in the body by means of one or more mounting brackets 68 each of which comprise a central sleeve 72 coaxially located on the outer surface of the stem 66 and a plurality of radially extending legs 70 engaging the inner surface of the valve 30.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

I claim:

1. In a paper machine drying section including a first series of drying cylinders in a top run and a second series of cylinders in a bottom run, upper and lower fabric loops cooperating with the first and second series, respectively, of said drying cylinders for guiding a paper web in a serpentine path around the surface of alternating cylinders of said top and bottom runs of drying cylinders with an open paper draw section between the cylinders of said first series in the top run and the second series of cylinders in the bottom run thereof, the improvement comprising:

apparatus for supplying air directly onto said paper web in said open draw while said paper web is not supported by cylinders, fabric or felt, said apparatus comprising:

at least one nozzle box being located in a dryer pocket adjacent to said paper web and including said means for supplying said air in a manner to inhibit flutter, blow-away or breakage of said web and including a plurality of radial jet reattachment nozzles on said nozzle box and located at spaced locations across the face thereof, and directed towards said paper web.

2. In a paper machine drying section including a first series of drying cylinders in a top run and a second series of cylinders in a bottom run, upper and lower fabric loops cooperating with the first and second series, respectively, of said drying cylinders for guiding a paper web in a serpentine path around the surface of alternating cylinders of said top and bottom runs of drying cylinders with an open paper draw section between the cylinders of said first series in the top run and the second series of cylinders in the bottom run thereof, the improvement comprising:

apparatus for supplying air directly onto said paper web in said open draw while said paper web is not supported by cylinders, fabric or felt, said apparatus comprising:

at least one nozzle box being located in a dryer pocket adjacent to said paper web and including said means for supplying said air in a manner to inhibit flutter, blow-away or breakage of said web, wherein said at least one nozzle box in said paper drying section is located in a dryer pocket adjacent to said paper web and extending between cylinders of said upper run and those of the lower run; and wherein a plurality of nozzle boxes are provided in said dryer section and wherein rows of nozzles in one box are aligned intermediate the nozzles in an adjacent box in an adjacent pocket with respect to the cross-machine direction of said paper web for a more uniform drying thereof.

3. The arrangement according to claim 2 wherein said nozzle box is pivotally mounted in said dryer pocket whereby said nozzle box and said nozzles thereon may be pivoted away from its operative position adjacent said paper web providing access thereto for threading and the like.

4. In a paper machine drying section including a first series of drying cylinders in a top run and a second series of cylinders in a bottom run, upper and lower fabric loops cooperating with the first and second series, respectively, of said drying cylinders for guiding a paper web in a serpentine path around the surface of alternating cylinders of said top and bottom runs of drying cylinders with an open paper draw section between the cylinders of said first series in the top run and the second series of cylinders in the bottom run thereof, the improvement comprising:

apparatus for supplying air directly onto said paper web in said open draw while said paper web is not supported by cylinders, fabric or felt, said apparatus comprising:

at least one nozzle box being located in a dryer pocket adjacent to said paper web and including said means for supplying said air in a manner to inhibit flutter, blow-away or breakage of said web and including a plurality of radial jet reattachment nozzles on said nozzle box and located at spaced locations across the face thereof, and directed towards said paper web and wherein said nozzle box comprises an elongated enclosure having a front face and providing a plenum body feeding each nozzle on said nozzle box with an amount of air; and a perforated nozzle protection shield mounted on the front face of said nozzle box and above said plurality of nozzles.

5. In a paper machine drying section including a first series of drying cylinders in a top run and a second series of cylinders in a bottom run, upper and lower fabric loops cooperating with the first and second series, respectively, of said drying cylinders for guiding a paper web in a serpentine path around the surface of alternating cylinders of said top and bottom runs of drying cylinders with an open paper draw section between the cylinders of said first series in the top run and the second series of cylinders in the bottom run thereof, the improvement comprising:

apparatus for supplying air directly onto said paper web in said open draw while said paper web is not supported by cylinders, fabric or felt, said apparatus comprising:

at least one nozzle box being located in a dryer pocket adjacent to said paper web and including said means for supplying said air in a manner to inhibit flutter, blow-away or breakage of said web including a plurality of radial jet reattachment nozzles on said nozzle box and located at spaced locations across the face thereof, and directed towards said paper web and wherein each of said radial jet reattachment nozzles comprises a cylinder member secured in the face plate of said nozzle box and directed outwardly therefrom, and a head having a stem coaxially positioned in said cylindrical portion and a head outwardly of and overlying the outer end of said cylindrical portion whereby air directed outwardly from said nozzle box through said cylindrical portion is directed parallel to said paper web by the position of said head.

6. An arrangement according to claim 5 including means associated with said nozzles for adjusting the airflow therefrom.

7. An arrangement according to claim 6 wherein said airflow adjusting means comprises a peripheral ring mounted on the outer surface of said nozzle body for slideable movement therealong whereby said ring can be moved to open or close the peripheral area between said nozzle head and the adjacent rim of said nozzle body.

8. An arrangement according to claim 6 wherein said airflow adjusting means comprises means for axially sliding said stem in said nozzle body whereby said head opens or closes the peripheral gap between the head and the nozzle body.

9. In a paper machine drying section including a first series of drying cylinders in a top run and a second series of cylinders in a bottom run, upper and lower fabric loops cooperating with the first and second series, respectively, of said drying cylinders for guiding a paper web in a serpentine path around the surface of alternating cylinders of said top and bottom runs of drying cylinders with an open paper draw section between the cylinders of said first series in the top run and the second series of cylinders in the bottom run thereof, the improvement comprising:

apparatus for supplying air directly onto said paper web in said open draw while said paper web is not supported by cylinders, fabric or felt, said apparatus comprising:

at least one nozzle box being located in a dryer pocket adjacent and perpendicular to said paper web;

said nozzle box extending substantially the full width of said dryer cylinders and said paper web draw; and a plurality of radial jet reattachment nozzles on said nozzle box and located at spaced locations across the face thereof and being directed towards said paper web.

10. An arrangement according to claim 9 wherein said at least one nozzle box is located in a dryer pocket adjacent to said paper web extending between cylinders of said upper run and those of the lower run.

11. In a paper machine drying section including a first series of drying cylinders in a top run and a second series of cylinders in a bottom run, upper and lower fabric loops cooperating with the first and second series, respectively, of said drying cylinders for guiding a paper web in a serpentine path around the surface of alternating cylinders of said top and bottom runs of drying cylinders with an open paper draw section between the cylinders of said first series in the top run and the second series of cylinders in the bottom run thereof, the improvement comprising:

apparatus for supplying air directly onto said paper web in said open draw while said paper web is not supported by cylinders, fabric or felt, said apparatus comprising:

at least one nozzle box being located in a dryer pocket adjacent and perpendicular to said paper web; and a plurality of radial jet reattachment nozzles on said nozzle box and located at spaced locations across the face thereof, and directed towards said paper web and wherein said at least one nozzle box is located in a dryer pocket adjacent to said paper web extending between cylinders of said upper run and those of the lower run and wherein a plurality of nozzle boxes are provided in said dryer section and wherein the rows of nozzles in one box are aligned intermediate the nozzles in an adjacent box in an adjacent pocket with respect to the cross-machine direction of said paper web for a uniform drying thereof.

12. The arrangement according to claim 11 wherein said nozzle box is pivotally mounted in said dryer pocket whereby said nozzle box and said nozzles thereon may be pivoted away from its operative position adjacent said paper web providing access thereto for threading and the like.

13. An arrangement according to claim 11 including means for adjusting the blow box relative to the distance between the face of the blow box and the paper web.

14. An arrangement according to claim 11 wherein said nozzle box comprises an elongated enclosure having a front face and providing a plenum body feeding each nozzle on said nozzle box with an equal amount of air, a perforated nozzle protection shield mounted on the front face of said nozzle box and above said plurality of nozzles.

15. An arrangement according to claim 11 including an elongated slot in the lower end of said nozzle box whereby air may be gently moved away from the web.

16. The arrangement according to claim 9 wherein each of said radial jet reattachment nozzles comprises a cylindrical member secured in the face plate of said nozzle box and directed outwardly therefrom, and a head having a stem coaxially positioned in said cylindrical portion and said head outwardly of and overlying the outer end of said cylindrical portion whereby air directed outwardly from said nozzle box through said cylindrical portion is directed parallel to said paper web by the position of said head.

17. An arrangement according to claim 16 including means associated with said nozzles for adjusting the airflow therefrom.

18. An arrangement according to claim 17 wherein said airflow adjusting means comprises a peripheral ring mounted on the outer surface of said nozzle body for slideable movement therealong whereby said ring can be moved to open or close the peripheral area between said nozzle head and the adjacent rim of said nozzle body.

19. An arrangement according to claim 17 wherein said airflow adjusting means comprises means for axially sliding said stem in said nozzle body whereby said head opens or closes the peripheral gap between the head and the nozzle body.

* * * * *